United States Patent [19]

Verboom

[11] 4,344,239

[45] Aug. 17, 1982

[54] DRAGGING TYPE HEAD FOR A SUCTION DREDGER

[75] Inventor: Pieter Verboom, Alblasserdam, Netherlands

[73] Assignee: IHC Holland N.V., Papendrecht, Netherlands

[21] Appl. No.: 169,208

[22] Filed: Jul. 15, 1980

[30] Foreign Application Priority Data

Jul. 17, 1979 [NL] Netherlands ..... 7905566

[51] Int. Cl.[3] ..... E02F 3/88

[52] U.S. Cl. ..... 37/66

[58] Field of Search ..... 37/66, 64, 58, 195, 37/189, 190, 72, DIG. 6

[56] References Cited

U.S. PATENT DOCUMENTS

| | | | |
|---|---|---|---|
| 2,309,157 | 1/1943 | Ariens | 37/189 UX |
| 2,364,666 | 12/1944 | Seaman | 37/189 UX |
| 3,171,220 | 3/1965 | Schram | 37/66 |
| 3,397,470 | 8/1968 | Hanson | 37/108 R |
| 3,524,510 | 8/1970 | Connell | 37/DIG. 6 |

FOREIGN PATENT DOCUMENTS

| | | | |
|---|---|---|---|
| 30359 | 1/1885 | Fed. Rep. of Germany . | |
| 183020 | 4/1907 | Fed. Rep. of Germany . | |
| 385421 | 11/1923 | Fed. Rep. of Germany . | |
| 7707296 | 6/1977 | Netherlands . | |
| 1383089 | 2/1975 | United Kingdom | 37/72 |

OTHER PUBLICATIONS

"The Suction Dredger Johanna Jacoba", Nivag Contour, vol. 3, May 1978, No. 5.

*Primary Examiner*—Clifford D. Crowder
*Attorney, Agent, or Firm*—Young & Thompson

[57] ABSTRACT

The invention relates to a dragging type head (1) of a suction dredger, the head having a driven cutting device in front of the suction tube mouth, which cutting device (5) rotates about a horizontal transverse axis and has cutting blades at its outer circumference. The main part of the cutting device (5) is enclosed by a cap (6) connected to the suction tube mouth (4). The cutting blades (e.g. 15,16,17,18,19 and 16', 17', 18', 19') are arranged in the form of several V-shaped patterns (11,12) upon the circumference with a channel digging type blade (15,20,27) at the leading top of each V. All the blades are shaped such that they move the cut material laterally towards the plane of the channel digging blades (15,20,27) and all the blades may be in the shape of a plough (28).

3 Claims, 3 Drawing Figures

DRAGGING TYPE HEAD FOR A SUCTION DREDGER

The invention relates to a dragging type head for a suction dredger, said head being provided with a cutting device operative to be driven and mounted in front of the mouth of the suction conduit in such a manner that the confines of the intake opening of the suction conduit extend to the substantially cylindrical cutting device, said cutting device being operative to be rotated about a horizontal axis and being provided with cutting blades at the outer circumference thereof, said cutting device further being operative to be driven in a cutting direction the same as the dragging direction and being enclosed by a cap running from the upper edge and lateral edges of said suction conduit and extending over the upper side and the lateral sides of said cutting device. A similar dragging type head has been described in Dutch Patent Application No. 78.02310. In the latter dragging type head the cutting blades run substantially parallel to the axis of rotation of the cylindrical cutting device, while a space exists between the inner side of the cutting blades and a cylinder body present therewithin through which space there is a suctional intake of water entering through the gap between the cap and the bottom, said water being capable of immediately rinsing away severed pieces or shavings of earth from the cutting blades and impelling the same into the suction mouth.

There are however types of soil strata in which this operation of radially peeling or shaving particles of earth will be less effective.

The object of the invention is to provide a solution for this problem which object is attained according to the invention in that the cutting blades consist of several sets of cutting blades, said sets of cutting blades being distributed over the circumference of the cylindrical body, each one of said sets of blades being arranged on the cylinder in a V-shaped pattern pointing in the direction of rotation, while the blade in each one of said sets of blades at the location of the point of the V-shaped pattern is a blade capable of digging a channel and the other blades of each set forming the legs of the V-shaped pattern and being spaced apart from each other make such an acute angle with respect to a plane perpendicular to the axis of rotation of the cutting means that they will exert a component of force in the direction of the plane running through the points of the sets having a V-shaped pattern. The cutting means now applied in accordance with the invention create a space by digging a channel by means of cutting blades destined thereto present at the location of the points of the V-shaped patterns, the latter cutting blades optionally being in a form like that known in principle for groove excavators. The cutting blades arranged in each set to the right and to the left thereof according to the legs of the V-shaped pattern will now always force the parts of the earth severed thereby axially towards the channel, while the flow of water drawn in and running between said blades will insure that the earth will be rinsed from said blades and be introduced into the suction mouth.

It is remarked that the Dutch Patent Application No. 71.16942 laid open to public inspection discloses a suction cutter head for a dredging machine in which in front of the suction mouth there is present a cutting device having a horizontal axis of rotation, said cutting device having a number of flat knives centrally in front of the mouth whereas mounted on the shaft running from the left hand and right hand side thereof there are knives exerting a component of force in the direction of the plane of rotation of said knives.

In this known apparatus the direction of rotation is opposite to the cutting direction and the cutting device is not enclosed on all sides by a cap contiguous with the suction mouth, while contrary thereto cutting blades are present mounted on the shafts extending from said central cutting device to both the left hand and the right side which cutting blades are entirely out of the operational reach of the suction mouth.

According to the invention it is preferred that the cutting blades are in the shape of a plough share whereby apart from the axial component of movement also a radial component is imparted to the severed material.

Furthermore it is preferred to mount each one of the cutting blades on a horizontal shaft and to keep the cutting blades in the operating position by means of spring action so that the blades may yield upon encountering additional resistance.

It is remarked that elastically yielding cutting teeth have been disclosed in Dutch Patent Application No. 78.07683, laid open to public inspection.

The invention will now be elucidated further with reference to the drawings, in which FIG. 1 shows the dragging type head according to the invention in such a cross section that the cutting blades are represented in side elevation;

FIG. 3 shows a development of the circumference of the cutting means body in another embodiment thereof.

Figure 1:
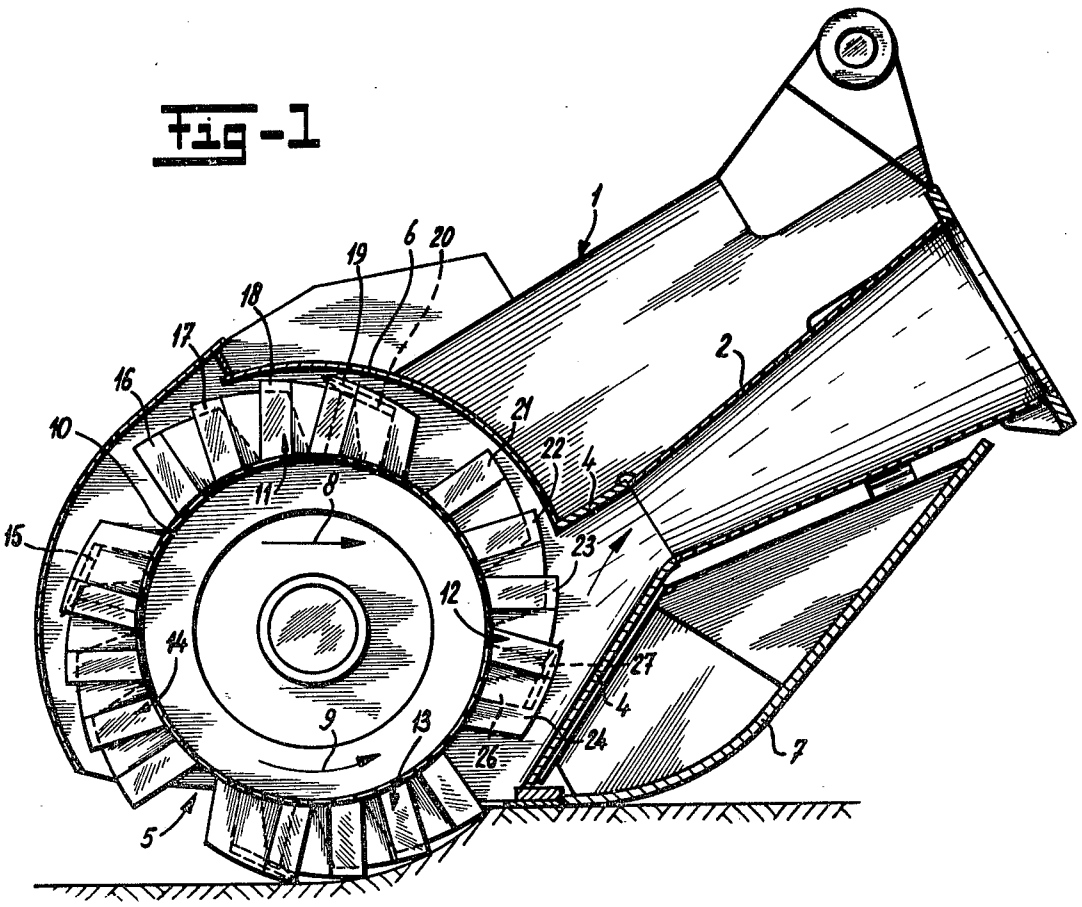

With reference to FIG. 1 there is shown a dragging type head 1 consisting of a suction conduit 2 connected to an unillustrated suction line, said conduit being in connection with the substantially cylindrical cutting device 5 through a widening 4, the construction being such, that the lower edge of the widening 4 merges almost tangentially into the circle described by the outer circumference of the cutting device. The upper edge of this widening 4 serving as the intake mouth of the suction line is contiguous with a cap 6 enclosing the cutting device for the main part thereof.

The reference numeral 7 indicates a guide shoe by means of which the dragging type head may be moved across the not yet treated bottom in the direction of the arrow 8 while the cutting device is rotating in the direction of the arrow 9.

This cutting device 5 consists of a cylinder mantle or body 10 which has been provided with cutting blades at the circumference thereof. These cutting blades have been arranged in sets 11, 12, 13 and 14 in such a manner that the front edges of the cutting blades of each one of said sets constitute a V-shaped pattern.

Thus the set 11 consists of a front blade 15 having such a profile that a channel may be dug by means thereof to which blade 15 there belong the other cutting blades 16, 17, 18 and 19 and 16', 17', 18' and 19' respectively.

In the set 12 the cutting blade at the front is indicated by the reference numeral 20 to which blade there belong the blades 21, 22, 23 and 24 and 21', 22', 23' and 24', respectively.

Figure 2:
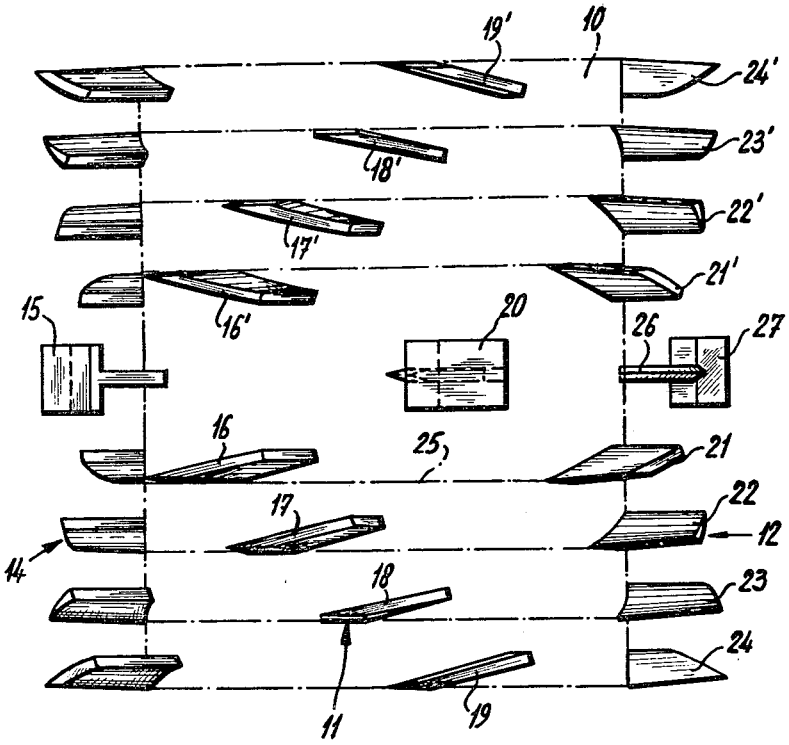
FIG. 2 shows a plan view of the cutting means body.
Figure 7:
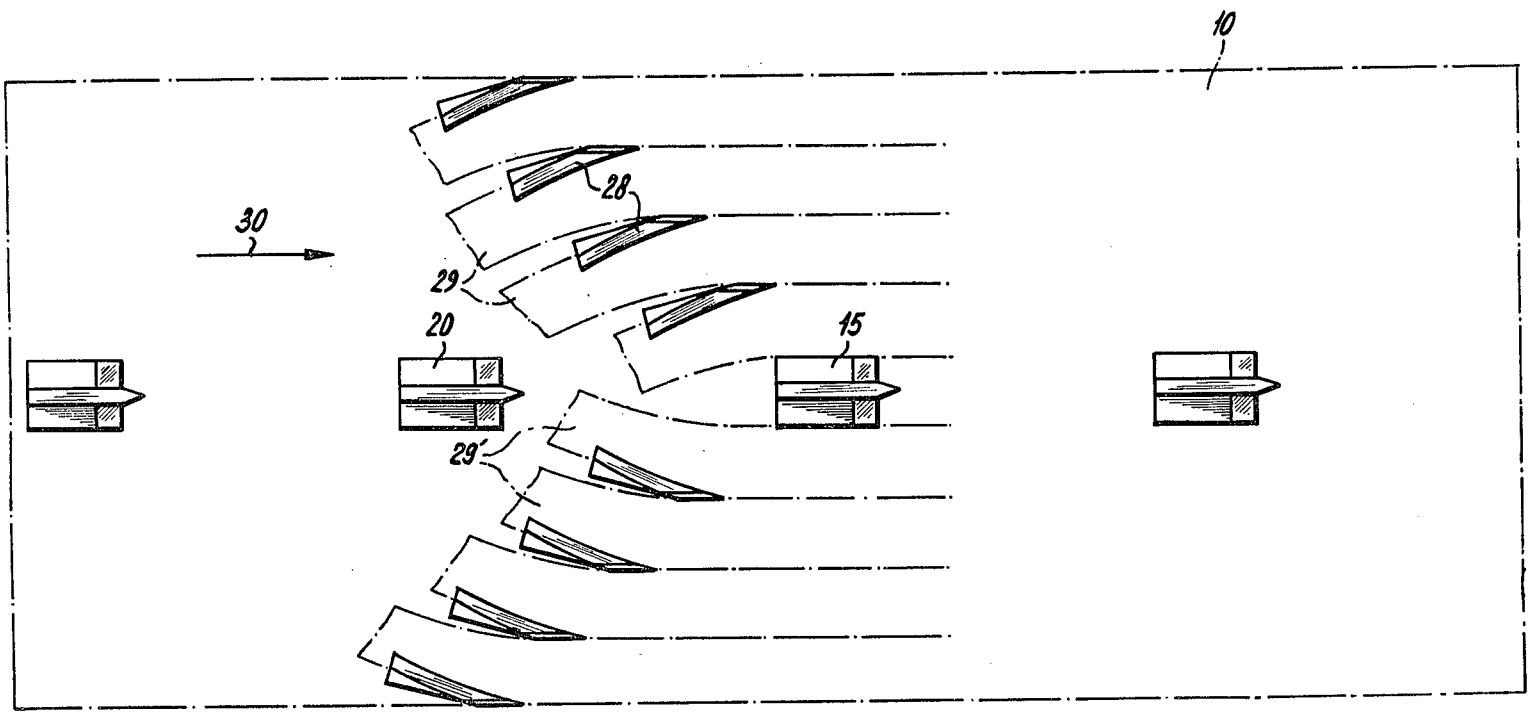

With reference to FIG. 2 it is clearly apparent that the blades 16 to 19 inclusive make such an acute angle with respect to the planes perpendicular to the axis of rotation, like the plane 25, that they will force the severed material in the direction of the channel dug by the blades 15, 20 etc. and also that the blades 16' to 19', inclusive perform in the same way although operating to the opposite direction.

The blades present at the location of the point of the V-shaped pattern, like the blades 15 and 20, consist of a vertical cutting blade 26 including at the top thereof a flat knife 27.

With reference to FIG. 3 there are shown cutting blades 28 of a somewhat different type. These cutting blades have been curved inward like a plough share so that they apart from exerting an axial component of force in the direction of the plane through the cutting blades 15, 20 etc. will also exert a radial component of force in the direction of the plane of the cylinder mantle. Thereby the material will also be cut off at the lower side thereof and be lifted.

The reference numerals 29 and 29' in FIG. 3 indicate the severing operation of the earth. The flow of water along the lower side of the cutting device occurs in the direction of the arrow 30. This flow of water will flow between the blades and bend and detach the severed shavings of earth followed by introducing this material into the suction mouth.

From FIG. 3 it will be apparent that the two legs of each one of the V-shaped sets of cutting blades 28 may be staggered somewhat with respect to each other in the direction of the circumference. In this way there will be created more room for the severed material as indicated by the paths 29 and 29'.

In case soil material, such as clay, will remain stuck between the blades the blades will be cleaned by the current flowing underneath the cap across the cylindrical body. Whenever such cleaning is of no success a loosening will occur upon the following cut. Moreover it is conceivable to provide the cap with means projecting between the blades by means of which a cleaning action may be exerted.

I claim:

1. In a dragging type suction head of a suction dredger, said head being provided with a cylindrical cutting device comprising a cylindrical drum rotatably supported within the suction head, said drum having upon its outer surface a plurality of cutting blades, said suction head having the form of a cap surrounding at least the upper portion of the cutting device and connected to a suction conduit; the improvement in which the cutting device is driven in a direction of rotation such that the force exerted by the cutting blades upon the soil is directed in the direction of dragging, the cutting blades being arranged upon the drum surface in several sets following each other in the circumferential direction of rotation of the drum, each set of blades having a leading blade and two rows of separate blades arranged according to the legs of a V extending rearwardly from said leading blade with respect to the direction of rotation, said leading blade being disposed in the central plane of the drum perpendicular to its axis and formed by a flat plate in said plane as well as a blade perpendicular to said flat plate, whilst the other individual and spaced apart blades of each set are at an acute angle to a plane perpendicular to the axis of the drum, each blade having its leading edge at a greater distance from the central plane than its trailing edge.

2. Suction head as claimed in claim 1 wherein the suction conduit has a suction mouth forming part of the head and has a lower wall extending substantially tangential to the outer circle of the blades and an upper wall extending substantially in a radial direction toward said circle.

3. Suction head as claimed in claim 1 wherein the cutting blades which extend at an acute angle to a plane perpendicular to the axis of the drum are curved between their leading and trailing edges.

* * * * *